US005193794A

United States Patent [19]

Steinhilber

[11] Patent Number: 5,193,794

[45] Date of Patent: Mar. 16, 1993

[54] DEVICE FOR AUTOMATIC DISPENSING OF SINGLE SHEETS AND THE LIKE

[76] Inventor: Helmut Steinhilber, Sonnenbergstrasse 40, CH-6052 Hergiswil, Switzerland

[21] Appl. No.: 633,332

[22] Filed: Dec. 27, 1990

[30] Foreign Application Priority Data

Dec. 28, 1989 [DE] Fed. Rep. of Germany ..... 3943136

[51] Int. Cl.[5] ..... B65H 3/44; B65H 3/06; B65H 1/22; B65H 3/54

[52] U.S. Cl. ..... 271/9; 271/10; 271/117; 271/162; 271/170; 271/171

[58] Field of Search ..... 271/9, 117, 121, 164, 271/170, 171, 275, 149, 158, 159, 162, 10, 11, 14, 267

[56] References Cited

U.S. PATENT DOCUMENTS

| | | | |
|---|---|---|---|
| 1,969,946 | 8/1934 | Root | 271/149 |
| 2,993,692 | 7/1961 | Thomas | 271/164 X |
| 3,807,723 | 4/1974 | Thomas | 271/9 X |
| 4,097,041 | 6/1978 | Fujimoto | 271/170 X |
| 4,538,799 | 9/1985 | Bhagwat | 271/164 X |
| 4,575,067 | 3/1986 | Ciatteo | 271/171 X |
| 4,616,816 | 10/1986 | Stauber | 271/9 X |
| 4,787,533 | 11/1988 | Haroutel et al. | 271/9 X |
| 4,878,799 | 11/1989 | Seto et al. | 271/9 X |
| 5,044,877 | 9/1991 | Constant et al. | 271/149 X |

FOREIGN PATENT DOCUMENTS

| | | | |
|---|---|---|---|
| 40350 | 3/1985 | Japan | 271/9 |
| 153352 | 8/1985 | Japan | 271/9 |
| 197542 | 10/1985 | Japan | 271/9 |

*Primary Examiner*—Robert P. Olszewski
*Assistant Examiner*—Boris Milef
*Attorney, Agent, or Firm*—Mason, Fenwick & Lawrence

[57] ABSTRACT

A device is described for automatically dispensing single sheets and the like, especially to an office machine. The device has a magazine in which stacks of single sheets can be inserted in freely selectable quantities and with freely selectable storage volume. A separating device is movable and positionable under control over the entire length of magazine in front of the ends of stacks. Stacks are immovably arranged in the magazine. The separating device engages between stacks and can be activated between stacks in order to pull one sheet off the selected stack and feed it to the office machine by transport means.

12 Claims, 16 Drawing Sheets

DEVICE FOR AUTOMATIC DISPENSING OF SINGLE SHEETS AND THE LIKE

The invention relates to a device for the automatic feed of single sheets and the like.

In order to feed single sheets to an office machine, to a printer, copier, or the like for example, single sheets are stacked in a magazine, pulled individually off the stack, and fed to the office machine. In order optionally to feed different kinds of single sheets to the office machine, a plurality of such stacks containing the various kinds of single sheets is provided and the single sheets, by automatic controls, are pulled off a selected stack and fed to the office machine. When the term "single sheets" is used herein, it shall apply, unless stated expressly to the contrary, generally to all kinds of single sheets, i.e. single sheets of different formats and different stiffnesses, to mulitple sets of single sheets or forms, and to cards, covers, etc.

If only two or three stacks of different types of single sheets are required, a separate separating device can be associated with each stack, which separates and removes the sheets from the stack. When the number of stacks is large, it is expensive to provide each stack with a separate separating device.

Apparatus as generally described above is known from U.S. Pat. No. 4,770,403, wherein a large number of stacks is arranged one above the other in a magazine. A separating device is movable in front of the ends of the stacks, and at a selected stack being controlled to pull a sheet off that stack. The sheets pulled off in this manner are transferred to a conveyor belt, which carries the sheets to the office machine. In this known apparatus, the individual stacks are arranged in cassettes displaceable between a resting position and a separating position. The selected cassette is pushed from the resting position into the separating position, in which it projects into the path of movement of the separating device, so that the separating device can engage the paper stack stored in the cassette and can pull the uppermost sheets off the stack.

In this known apparatus, each cassette must have a control and displacement mechanism associated with it. In addition, a separate cassette is required for each stack. If single sheets of different formats are to be stored, different cassettes will also be required. All of this makes the device expensive, particularly when the number of stacks is large. The number of holders and displacement devices for the cassettes in this known device determines the number of stacks that can be provided. The height of the cassettes also determines the maximum holding volume for each individual stack.

An important object of the present invention is to provide an apparatus for the automatic feed of single sheets to an office machine which provides the user with considerable flexibility regarding the number and quantity of different kinds and sizes of single sheets that can be supplied.

In the apparatus according to the invention, the supports for the stacks can be inserted at arbitrary intervals into the magazine. Thus, the user can choose freely how many supports he inserts, thus determining the number of stacks with different types of single sheets. In addition, he can also provide infinitely variable spacing of the supports so that he can determine the holding volume and/or thickness of the individual stacks to meet his specific requirements. In this way, no space is consumed by unnecessary cassettes, and no space is taken up by unnecessarily thick stacks of types of paper that are required infrequently. The total holding capacity of the magazine can therefore be optimally divided by each user to meet his individual requirements.

It is possible to associate a separate separating device with each stack, from which a sheet is selected by operation of an automatic control. The larger number of separating devices makes the device expensive. In addition, controlling the separating devices, whose positions are freely adjustable together with the support means, is expensive. Preferably, therefore, only a single separating device is provided which is movable in front of the ends of the stacks and is positionable by an automatic control.

Advantageously, the stacks are immovably positioned in the magazines and the separating device has a pulling device activatable between the stacks. In this embodiment, the apparatus requires no devices of any kind permanently installed in a fixed position relative to the stacks, so that it is especially easy to insert the stacks freely into the magazine. The movable separating device determines the actual position of each stack in the magazine to allow the separating device to pull a sheet from the stack in the desired number and in the desired order.

Preferably, the apparatus is mounted in a cabinet housing which forms an attractive piece of office furniture the height of a table, on which, for example, the office machine can be placed. The apparatus is advantageously movable outward laterally from this cabinet housing, for example extractable on telescoping tracks like a drawer, permitting convenient access to the magazine for loading the stacks of paper (so-called front loading). The cabinet housing has a dispensing slot through which the individual sheets are passed to the office machine. The arrangement of this dispensing slot and suitable paper guides permit the apparatus to be readily adapted to different types of office machines. The apparatus can also be used, for example, as a form dispenser in which a selected form can be removed from the dispensing slot.

A movable carriage is provided which carries at least the movable parts of the separating device. These parts of the separating device are movable mounted on the carriage, so that they can be moved from the carriage against the stack when the carriage moves under control into the position of the selected stack.

The magazine preferably has a box-shaped receiving chamber formed by four lengthwise rails. Preferably, the arrangement of this box-shaped receiving chamber is horizontal so that the stacks can be placed in the magazine on their ends. The two upper lengthwise rails can also serve as running rails for the carriage. In this embodiment, the support for the stack can easily be installed in the receiving chamber. Alternatively, to adapt the receiving chamber to different page formats, tubs can be suspended therein having profiles which correspond to the different sheet formats. The tubs are advantageously connectable with one another in series, in order to adjust their individual capacities to the requirements for sheets of the corresponding format.

With a vertical arrangement for the box-shaped receiving chamber, suitable supports must be provided for holding stack support plates in a shelfwise manner, at different heights. In this embodiment, additional guides for the carriage are also advantageous.

The separating device can be constructed in a number of different ways, but comprise a separating device and a pull-off device. The pull-off device serves to pull the uppermost or end sheet off the stack while the separating device ensures that only one sheet at a time is pulled off the stack.

Both the pull-off means and the separating means can be mounted on the carriage and be moved between the stacks for activation when the carriage has reached the selected position. A pneumatic system can be used for this purpose in which a suction bar provided with suction cups is moved between the stacks and evacuated for activation, as soon as the suction cups rest on the uppermost sheet on the stack. The suction bar pulls the uppermost sheet upward off the stack and therefore serves both as a pull-off means and a separating means.

In another version, the pull-off means can be drivable friction means which are moved from the carriage between the stacks and engage the uppermost sheet of the selected stack in order to pull the latter off the stack. The friction means can be separating rollers, separating fingers, or the like, having a frictional or adhesive surface. The separating means are preferably separating corners which likewise move from the carriage between the stacks and are brought to rest against the uppermost corners of the selected stack.

It is also possible to dispose only the pull-off means on the carriage and to move them between the stacks for activation. The pull-off means similarly can be driven by separating rollers, separating fingers, or the like. The separating means on the other hand are arranged separately for each stack. For this purpose, pivotable and spring-loaded separating corners can be mounted on the support plates, as is known, for example, in paper cassettes. An especially advantageous solution however consists in a separating frame which is placed in the form of a simple lightweight plastic part loosely on the stack and bears the separating corners. In contrast to separating corners that are pivotably mounted under spring tension on the support plates, this embodiment has the advantage of being simpler and less expensive. In addition, in this embodiment, there are no limitations regarding the thickness of the stack so that the high flexibility of the device relative to the number and holding volume of the stacks is retained.

It is also possible to have an embodiment in which the pull-off means and the separating means are formed by push frames which are inserted into the magazine in front of the stacks and when the magazine is mounted horizontally, they are preferably freely inserted into the magazine. The push frames engage the uppermost sheet in the stack with friction means. The carriage is then equipped with actuating means which are movable transversely to its direction of travel relative to the stacks and engage the corresponding push frame in the selected stack, moving said frame parallel to the surface of the stack so that the uppermost sheet is pulled off by the push frame. This design is especially suitable for single sheets with high stiffness in which separating corners are difficult or impossible to use. With such single sheets with high stiffness the push frame both pulls off the sheet and separates it.

The transport means that transport the single sheets pulled off the selected stack to the dispensing slot in order to transfer the single sheet to the office machine can likewise be designed in a variety of ways.

In one advantageous embodiment, the carriage simultaneously serves as a transport means. The single sheet pulled off the stack are received by the carriage, held in the carriage, and transported by means of the carriage to the dispensing slot.

In another embodiment which is especially suitable for thin, lightweight single sheets, an endlessly circulating conveyor belt that extends over the entire length of the magazine is provided in front of the ends of the stacks, said belt receiving the sheets pulled off the stack, transporting them to the dispensing slot, and transferring them there to the office machine. The conveyor belt can be operated under vacuum in order to grip the sheets by the action of suction. Preferably, the conveyor belt can be given an electrostatic charge so that the sheets are held to the conveyor by electrostatic attraction.

The invention will now be described in greater detail with reference to the embodiments shown in the drawing.

DESCRIPTION OF THE PREFERRED EMBODIMENTS

Figure 1:
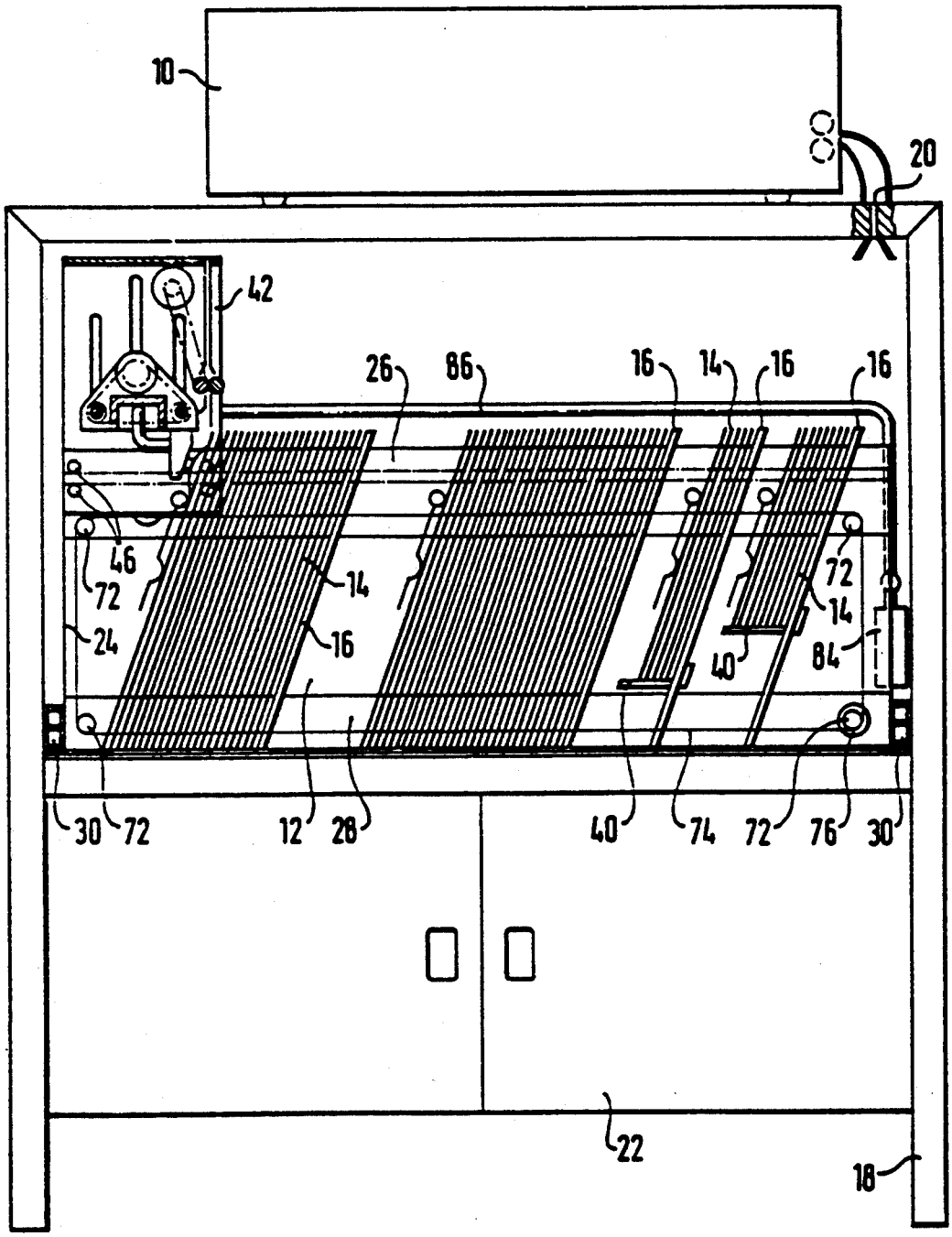
FIG. 1 is a side view of a first embodiment of the apparatus for automatically feeding single sheets.
Figure 2:
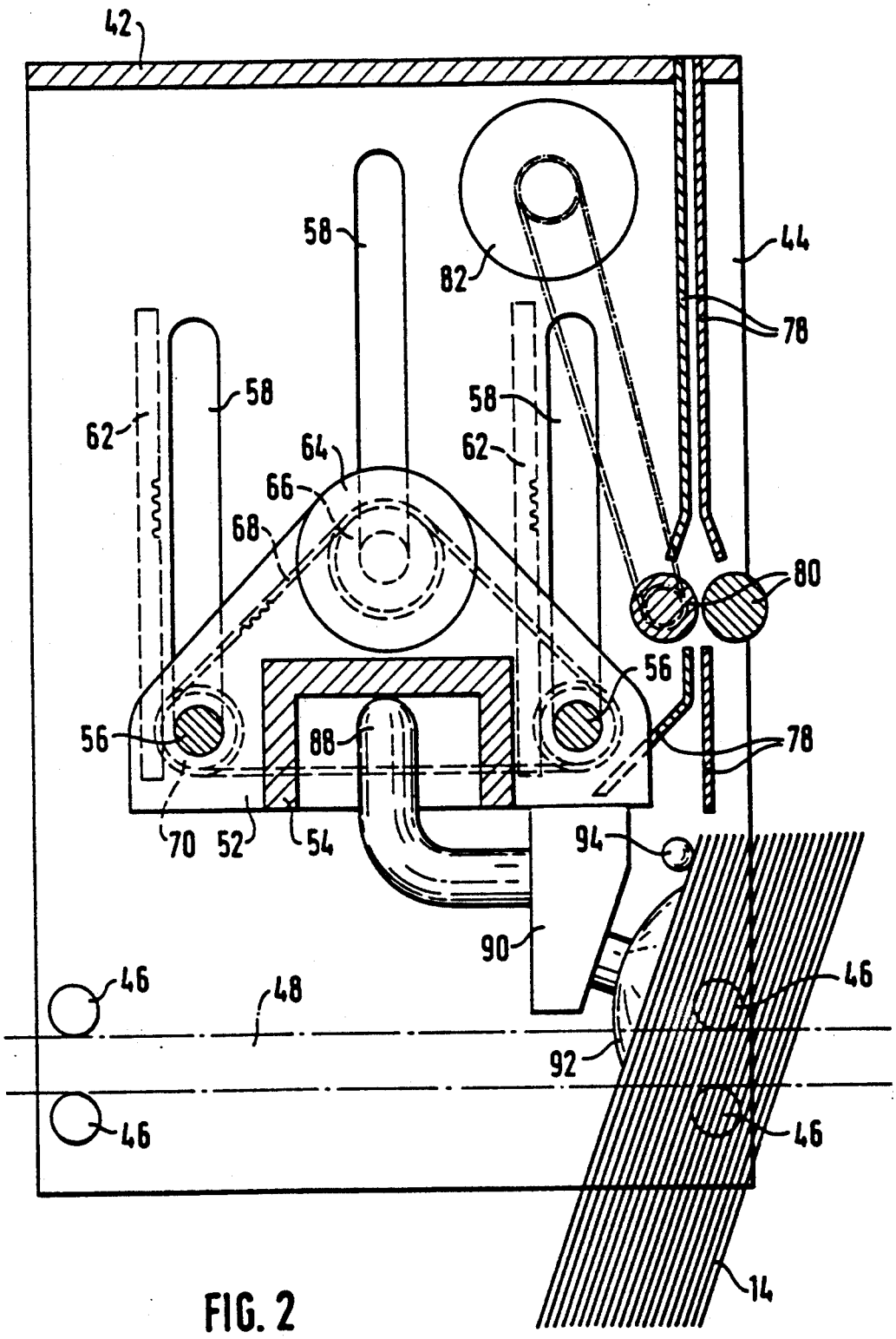
FIG. 2 is an enlarged partial section of the carriage of the apparatus of FIG. 1.
Figure 3:
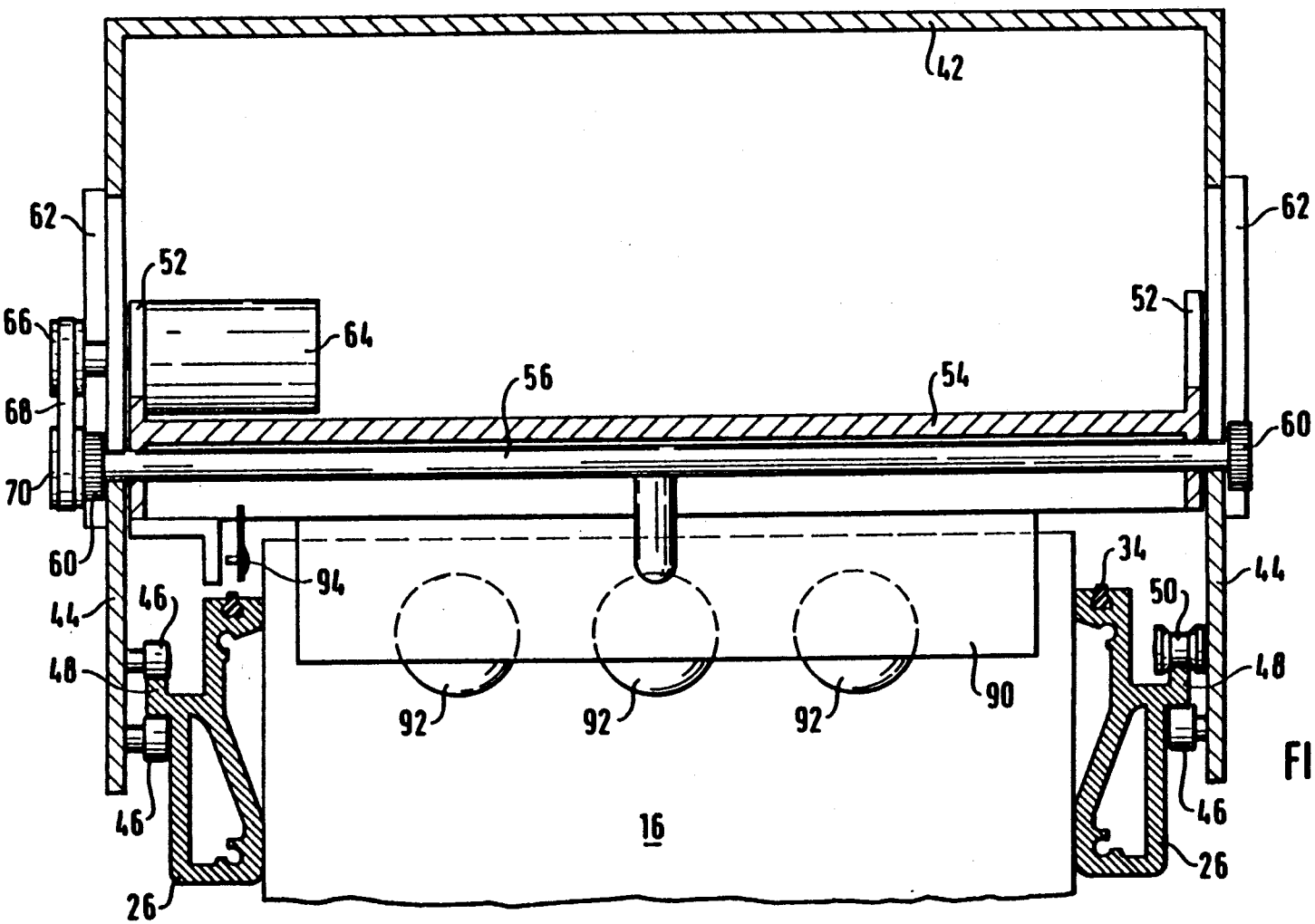
FIG. 3 shows the carriage of the first embodiment in cross-section.

A first embodiment of the invention is shown in FIGS. 1 to 3, and is discussed below.

Single sheets of different types can be fed to an office machine 10, e.g. a data printer, copier, or the like. These may be single sheets of different formats, different grades, or different imprints. Likewise, they may be form sets, covers, or the like. The number of different types of single sheets that can be available and the quantity of single sheets of each type that are stored may be selected individually by each user.

For this purpose, a magazine 12 is provided in which stacks 14 of the different kinds of single sheets, form sets, covers, and the like are inserted and held by suitable support means, e.g. in the form of support plates 16. Support plates 16 can be inserted in any quantity and with any spacing between them into magazine 12, thereby determining the number and storage volume of stacks 14. A separating device is movable in front of the ends of stacks 14, being capable of being moved by automatic controls to a selected stack in order to remove a single sheet from this stack and to feed it to office machine 10 by suitable transport apparatus. Advantageously, magazine 12 is housed in a table-height cabinet housing 18 and is removable therefrom for loading stacks 14. Office machine 10 in this embodiment can advantageously be placed on cabinet housing 18 and the single sheets can be fed through a dispensing slot 20 in cabinet housing 18 to office machine 10. A cabinet box 22 can also be provided beneath magazine 12 in cabinet housing 18, to hold, for example, accessories for office machine 10 or an additional paper supply.

In the embodiments shown, support plates 16 are inserted vertically into magazine 12 so that stacks 14 stand substantially perpendicularly behind one another in the magazine and the separating device travels horizontally over the stacks. Of course, it is also possible to position the support plates essentially horizontally in the magazine so that stacks 14 lie horizontally and one above another, and the separating device is movable vertically in front of the stacks. The construction of such a device is obvious to an individual skilled in the art from the description which follows.

Magazine 12 has four rails that extend horizontally over the entire length of magazine 12 and are screwed at their ends to vertical cover panels 24 to form a box-shaped holding chamber. Each of the rails that runs left and right at the top of magazine 12 is a running rail 26, having the cross-section shown in FIG. 3. The two bottom rails 24 that run left and right at the lower edge are shown in cross-section in FIG. 8. Bottom rails 28 have bottom ribs directly inwardly toward one another, which ribs the support plates 16 and stacks 14 rest.

The entire magazine 12 is mounted in cabinet housing 18 at its two ends by telescoping rails 30, so that magazine 12 can be slid sideways out of cabinet housing 18.

Figure 4:
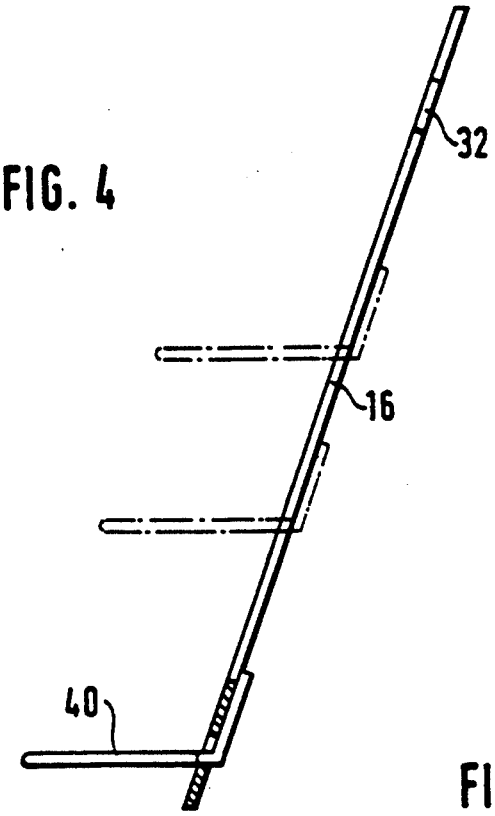
FIG. 4 shows a support plate of the device in FIG. 1 in a vertical lengthwise section.
Figure 5:
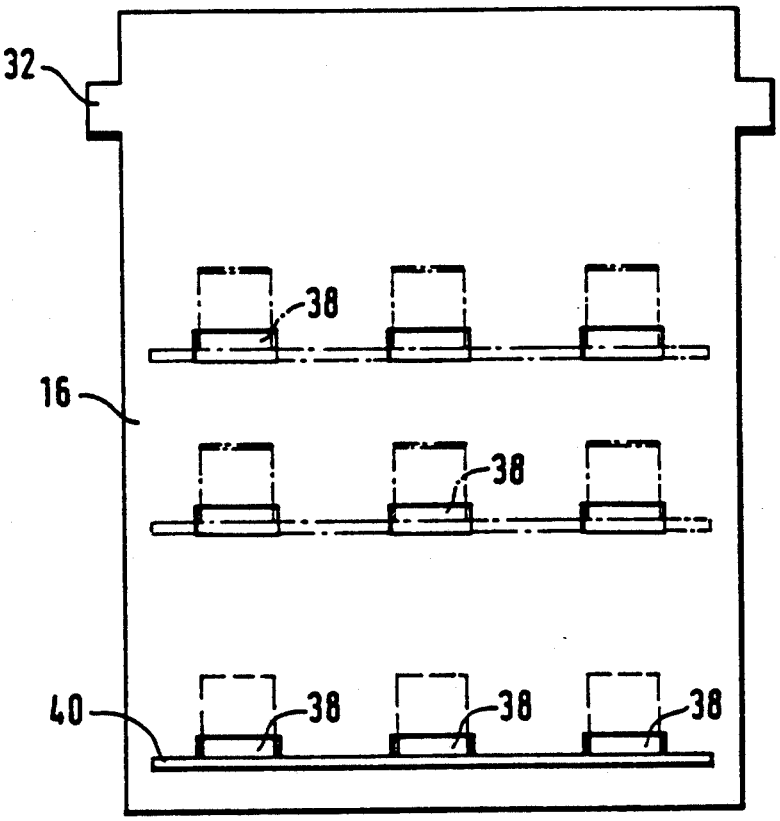
FIG. 5 is a front view of the support plate of FIG. 4.

Support plates 16 can be inserted in any desired quantity and arrangement in the box-shaped receiving chamber formed of upper running rails 26 and lower bottom rails 28. FIGS. 4 and 5 show one embodiment of the support plates 16. The width of support plates 16 corresponds to the distance between running rails 26 and bottom rails 28. At their upper ends, support plates 16 have laterally projecting noses 32. The distance between noses 31 and the lower edges of support plates 16 is slightly greater than the vertical distance between the upper edges of running rails 26 and the inner bottom ribs of bottom rails 28. When support plates 16 are inserted into magazine 12, they therefore tilt slightly out of the vertical until noses 32 rest on the upper edges of running rails 26. Rubber or plastic inserts 34 (see FIG. 3) are inserted into the upper edges of running rails 26, and rubber or plastic inserts 36 (see FIG. 8) are likewise inserted into the bottom ribs of bottom rails 28. These rubber or plastic inserts 34 and 36 hold the support plates 16 so that they will not slide, when they rest with their lower edges on the bottom ribs of bottom rails 28 and with their noses 32 on running rails 26 in the above-mentioned sloping position. When support plates 26 have been inserted in the desired quantity and positions, the desired stacks 14 can be loaded, said stacks being inserted into the magazine in front of support plates 16. Stacks 14 likewise rest on rubber or plastic inserts 36 and are prevented by the latter from sliding off support plate 16.

In order to store single sheets of different formats or sizes, support plates 16, as shown in FIGS. 4 and 5, preferably have horizontal slots 38 arranged at different heights. Support angles 40 can be held in these slots 38 at the desired heights, as shown in FIG. 4. A stack of single sheets of smaller format, covers, or the like can then be placed on these selectively positioned support angles 40, so that the upper edges of these stacks are flush with the upper edges of larger-format stacks 14, which rest on bottom rails 28, as shown in FIG. 1. Support angles 40 are likewise provided with rubber or plastic inserts, that prevent the standing stacks from slipping.

A carriage 42 which is a part of the separating device is located above the box-shaped receiving chamber of magazine 12, extending bridgewise transversely above the receiving chamber. Carriage 42 has cheeks 44 (see FIG. 3) directed downward on both sides of the receiving chamber extending downward outside running rails 26. Two pairs of rollers 46 are arranged on the inside of each cheek 44. Each pair of rollers 46 rests on the top and bottom of a guide rib 48 of the profile of running rails 26. An upper guide roller 50 is axially immovable, due to a circumferential groove, and rests on guide rib 48 of a running rail 26. This permits a precisely defined adjustment of carriage 42 relative to the running rails 26.

Support plates 52 are mounted above running rails 26 in carriage 42 on the insides of cheeks 44, said plates being connected together by a cross member 54. A pair of shafts 56 are shown in FIG. 2, to be rotatably mounted in support plates 52, on both sides of cross members 54. Shafts 56 have their two ends projecting respectively through vertical guide slots 58 in cheeks 44. Outside cheeks 44, pinions 60 are mounted on the ends of shafts 56, said pinions running in racks 62 mounted parallel to guide slots 58 on the outside of cheeks 44. An electric motor 64 is supported by one of the support plates 52 above cross member 54. The drive shaft of electric motor 64 projects through a vertical guide slot 58 of the adjacent cheek 44. Outside cheek 44, a pulley 66 is mounted on the drive shaft of electric motor 64. A toothed belt 68 runs over pulley 66 and pulleys 70 which are mounted on the ends of shafts 56. When electric motor 64 is energized, support plates 52 with cross member 54 in carriage 42 can be moved up and down.

On one side of magazine 12, as shown in FIG. 1, deflecting rollers 72 are mounted on the respective ends of running rails 26 and bottom rails 28, over which rollers a drive cable 74 runs and can be driven by a motor 76. The corresponding cheek 44 of carriage 42 is connected to the top run of drive cable 74, so that carriage 42 can be moved on running rails 26 by motor 76.

In addition, an upwardly directed paper guideway (FIG. 2) is provided by plates 78 and transport rollers 80 in carriage 42, the rollers 80 being drivable by a motor 82 mounted in carriage 42. A photocell 94 is mounted on a cheek 44, below the guideway.

A vacuum pump 84 (FIG. 1) is mounted on magazine 12, which is connected by a flexible hose 86 and a controllable valve to a connecting stub 88 on carriage 42. Connecting stub 88 connects to a suction bar 90 mounted beneath cross member 54 on support plates 52 and extending essentially over the full width of support plates 16. Suction bar 90 is provided with suction cups 92, and functions as a sheet pull-off device.

In the embodiment shown in FIGS. 1 to 3, the apparatus operates as follows:

Initially, the user determines how many different kinds of paper will be required and what quantity of each kind of paper will be needed. Support plates 16 are then inserted accordingly into magazine 12. Then the paper is loaded into stacks 14. In the case of smaller paper formats or sizes, support angles 40 are inserted as appropriate into support plates 16. The number of support plates 16 and the thickness of stacks 14 is limited only the requirement that a sufficient space be left between each support plate 16 and the next stack 14, so that suction bar 90 carriage by carriage 42 can pass between stacks 14.

Before the separating function is triggered, carriage 42 is moved once over the entire magazine by motor 76. The photocell 94, or a microswitch, combined with a position memory, (not shown) detects the exact position of the uppermost sheet in each stack 14 and stores this information electronically. This detection process can take place during each separation, with the total paper supply being monitored and possibly indicated on a display. In addition, the quantity of single sheets loaded per stack can be entered by a keypad and monitored. The computer controlling office machine 10 transmits a command to select a specific single-sheet format, a specific form, a cover, or the like. This command is converted into corresponding mechanical or electromechanical steps in a microprocessor, not shown, which controls the device. These steps control the power supplied to motor 76. The motor drives carriage 42 through drive cable 74, bringing the latter into the desired position. Then electric motor 64 is energized and drives pinions 60 through toothed belt 68, so that the pinions run downward in racks 62, and support plates 52 with cross member 54 move downward. Suction bar 21 descends between the selected stacks 14 and support plate 16 of the previous stack 14 and lays its suction cups 92 on the uppermost sheet of stack 14.

At this point, the valve of vacuum pump 84 opens under electronic control so that a vacuum is applied through hose 86 to suction bar 90 and suction cups 92. The suction picks up the uppermost sheet of stack 14. Then electric motor 64 is energized in the opposite direction, so that support plates 52 move upward by means of pinions 60 which are now driven in the opposite direction, and suction bar 90 with suction cups 92 pulls the uppermost sheet off stack 14 and carries the sheet upwardly. The sheet is pushed into the entry into the paper guideway and rests with its top edge on transport rollers 80 and its top portion bent convexly. Then transport rollers 80 are briefly driven by motor 82 so that they engage and grip the raised sheet. Then motor 76 is energized so that carriage 42 is guided to dispensing slot 20 in magazine 12. As it does so, the sheet gripped firmly between transport rollers 80 is pulled completely off stack 14 and carried away. When dispensing slot 20 is reached, the valve disconnects the vacuum pump 84 from suction bar 90 and suction bar 90 is vented to atmosphere. Then motor 82 is energized again so that transport rollers 80 transfer the sheet to office machine 10 through dispensing slot 20.

Figure 6:
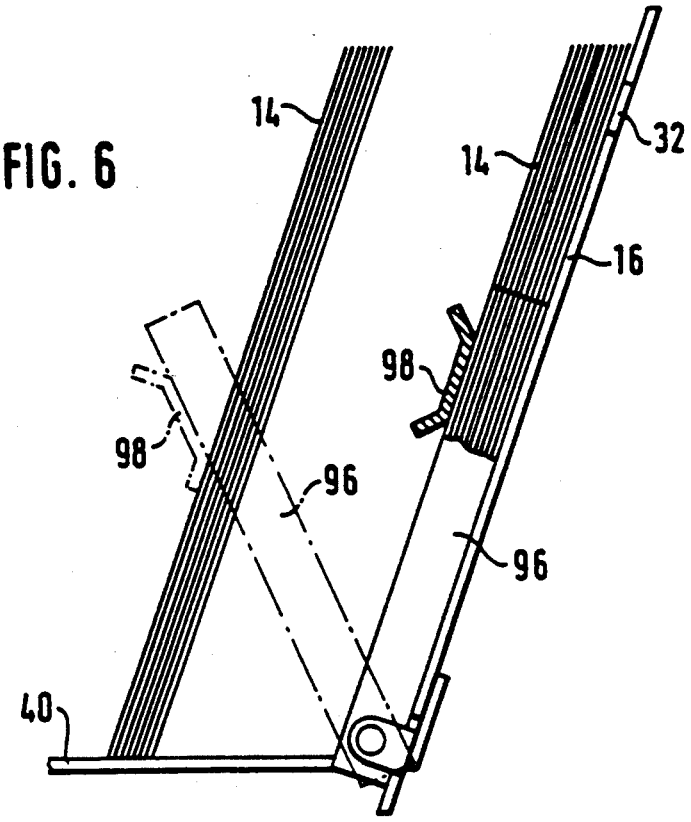
FIG. 6 shows a modified embodiment of the support plate in a side view.
Figure 7:
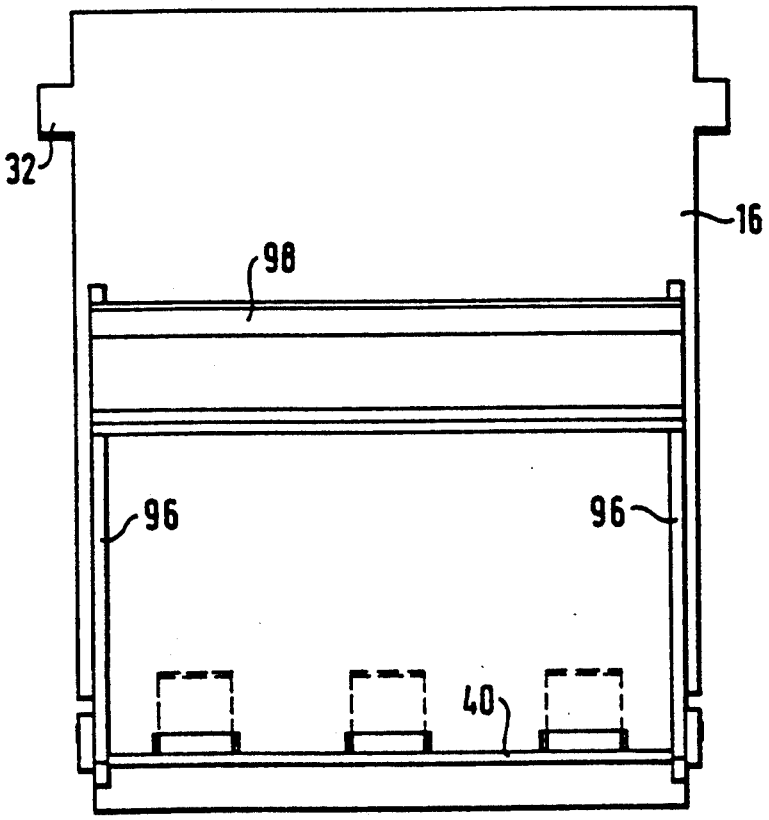
FIG. 7 shows the support plate in FIG. 6 in a front view.

In order to align stacks 14 precisely edgewise on support plates 16, a pivoted guide strip 96 is mounted on each side of the lower ends of support plates 16, as shown in FIGS. 6 and 7. Guide strips 96 form the lateral boundaries of stack 14. A cross strip 98 connects the upper ends of guide strips 96 in order to maintain the latter stably at the distance that delimits stack 14. Guide strips 96 are frictionally mounted on support plates 16 so that they remain standing in any angular position. As indicated by the dashed lines in FIG. 6, guide strips 96 can be swung far out from support plates 16 to insert a thick stack 14. Since guide strips 96 remain standing in the tilted position because of friction, they do not prevent stack 14 from being inserted. When stack 14 is thinner, guide stirps 96 with cross strip 98 are swung against stack 14 after it is inserted, as shown by the solid lines in FIG. 6, to ensure sufficient lateral guidance of stack 14 by guide strip 96.

Figure 8:
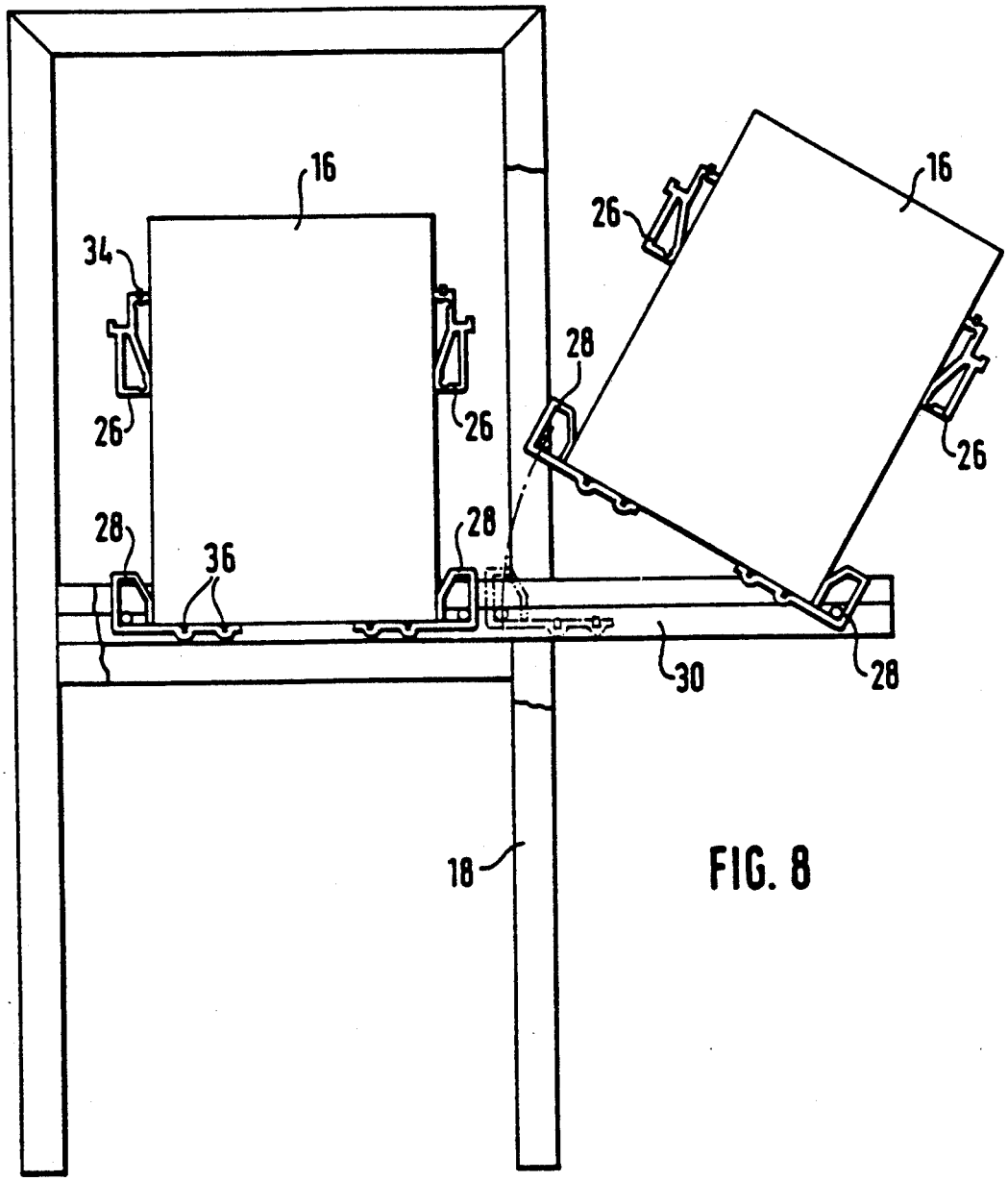
FIG. 8 is a modification of the device in a vertical cross-section.

FIG. 8 shows an additional measure which can be provided firstly to facilitate loading of stacks 14 into the magazine and secondly to ensure an exact reference position for the side edges of the individual sheets for the entire single-sheet feeding process. When the magazine has been extracted from cabinet housing 18 by means of telescopic rails 30, as shown in FIG. 8, the box-shaped magazine body can be tilted outward through a certain angle with outer bottom rails 28 as a pivot axis. This provides improved access for inserting stacks 14 between running rails 26. This also ensures that inserted stacks 14 rest reliably with their vertical edges on the right in FIG. 8 on outer running rails 26 and outer bottom rails 28. These outer running rails 26 and outer bottom rails 28 thus form a precise edge reference for inserted stacks 14. Since carriage 42, as shown in FIG. 3, is also guided exactly by guide roller 50 on outer running rails 26, this precise edge reference is maintained even when the single sheets pulled off stack 14 are transferred to carriage 42 and therefore during transfer to office machine 10.

Figure 9:
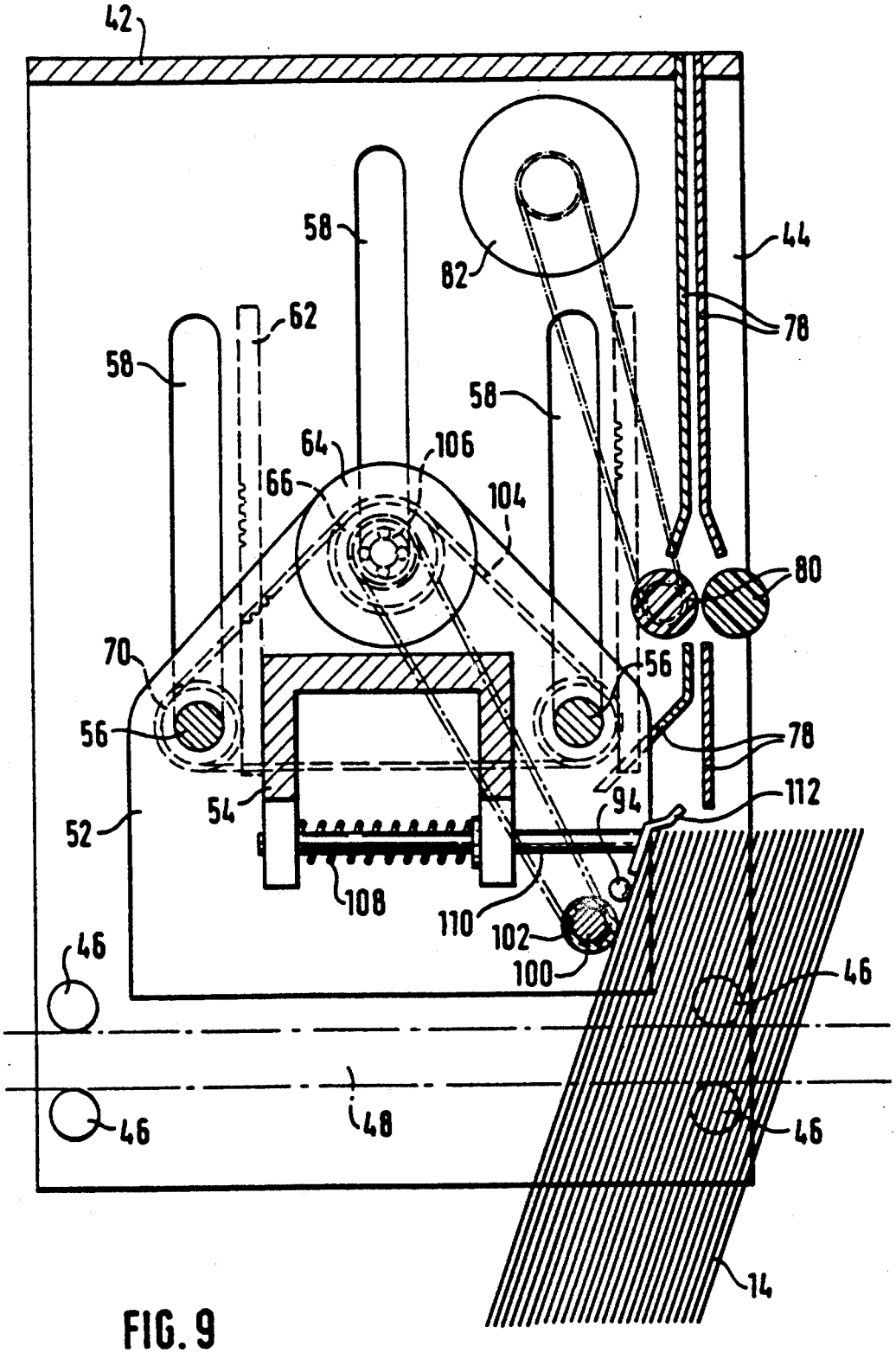
FIG. 9 is a drawing of the carriage in a second embodiment corresponding to FIG. 2.
Figure 10:
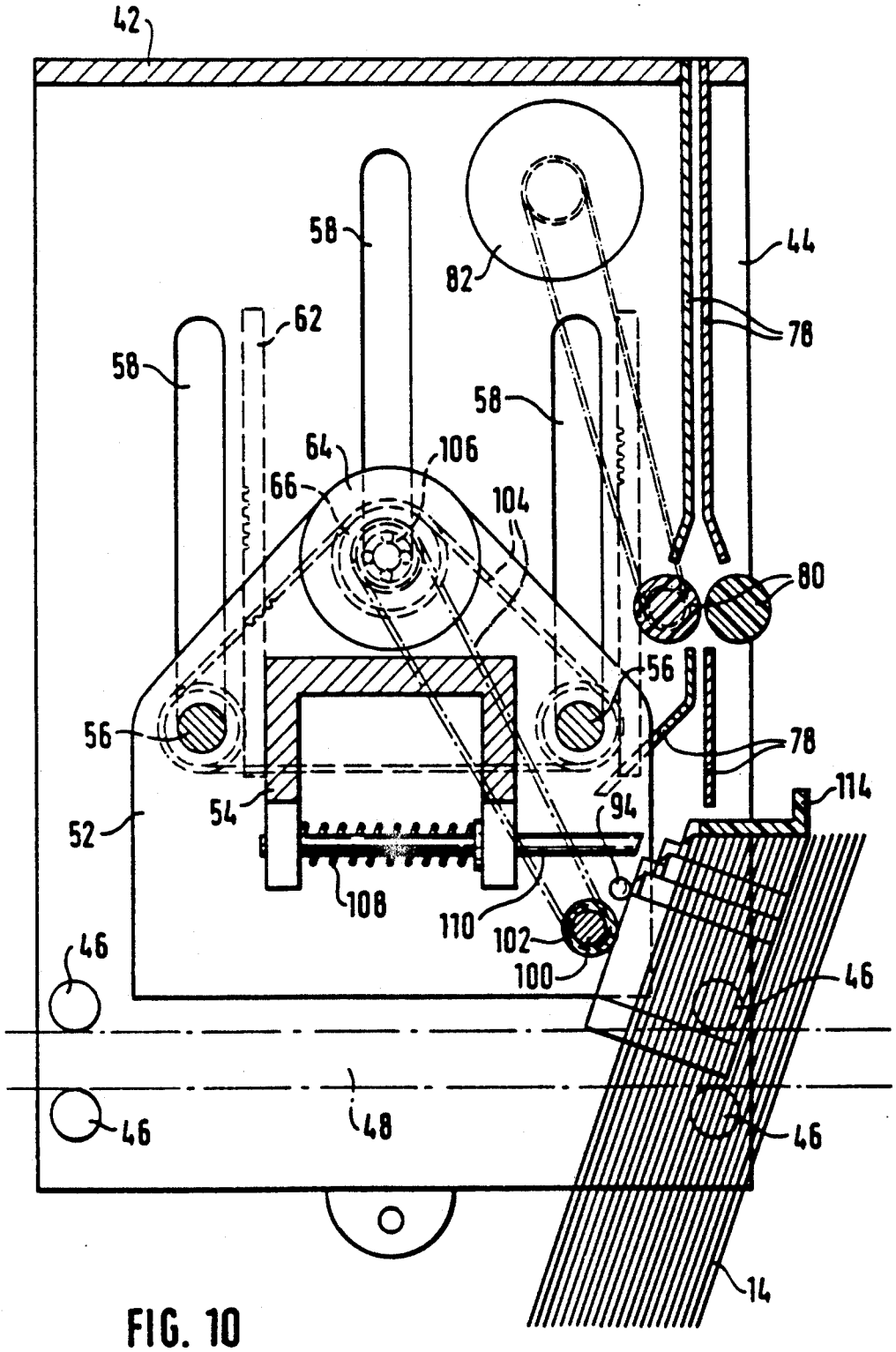
FIG. 10 is a view of the carriage in a third embodiment corresponding to FIG. 2.
Figure 11:
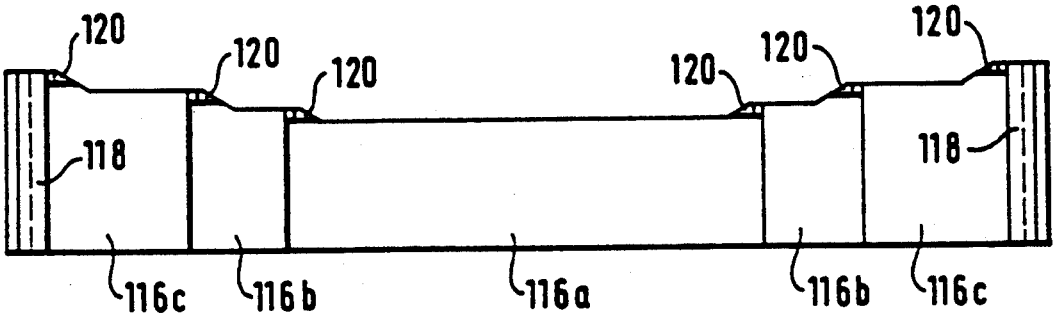
FIG. 11 is a view of the separating frame of FIG. 10 from the paper side.
Figure 12:
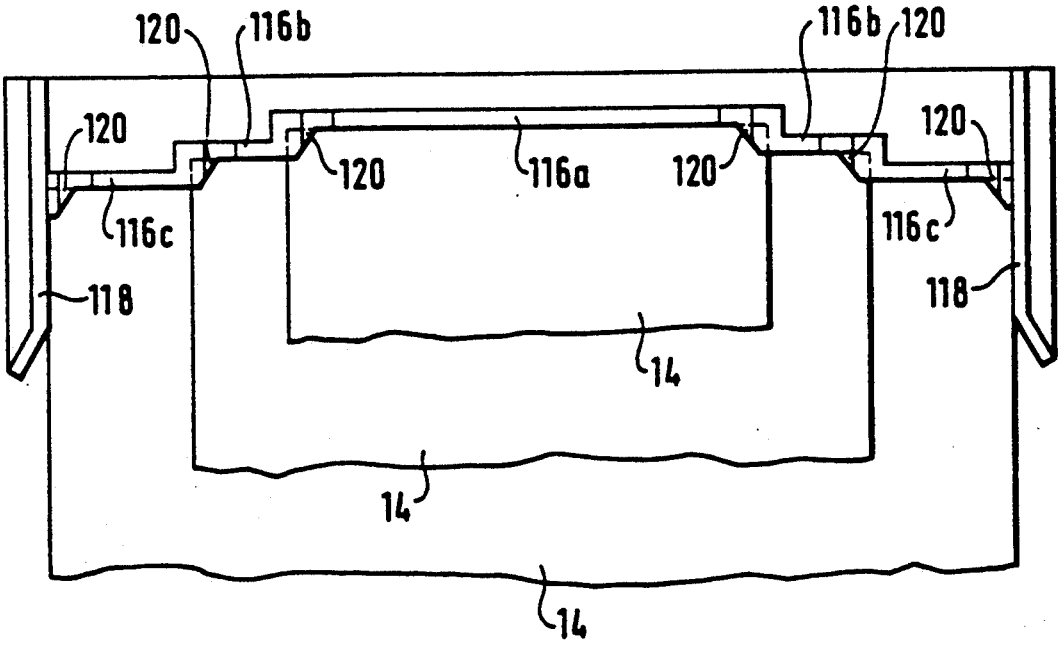
FIG. 12 is a top view of the separating frame.
Figure 13A:
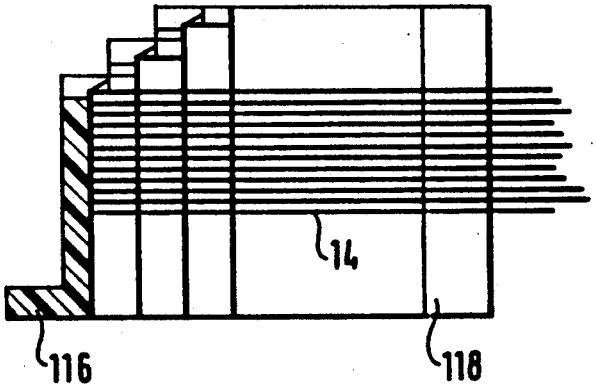
FIGS. 13*a*–13*c* are sections through the separating frame.
Figure 13B:
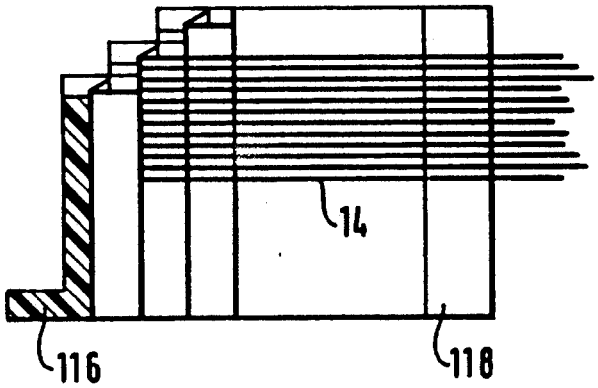
Figure 13C:
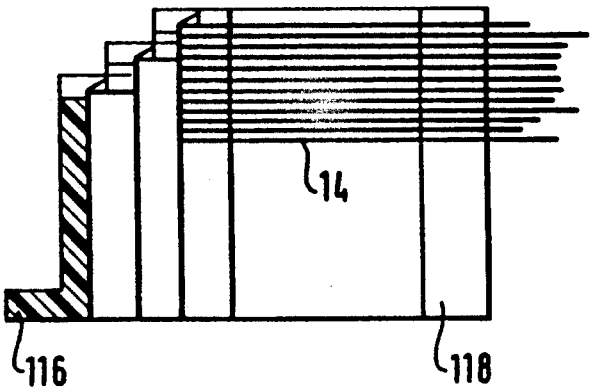

FIG. 9 shows a second embodiment. This second embodiment differs from the first embodiment described above only in the design of the separating device. Therefore, FIG. 9 shows only carriage 42 with the separating device. Reference is made to the previous description for the components of the device which are not shown and their functions. Reference is also made to the previous description to the extent that the embodiment of FIG. 9 is not changed from the previous embodiment, especially FIG. 2.

In the second embodiment, a separating shaft 100 is mounted in support plates 52 of carriage 42 below cross member 54, said shaft bearing frictional separating rollers 102. Separating shaft 100 is driven by electric motor 64 through a toothed belt 104. A free-running clutch 106 ensures that separating shaft 100 is only driven when electric motor 64 is energized in the direction of rotation in which support plates 52 are moved downward. Pulley 66 is mounted by a slip clutch on the drive shaft of electric motor 64, so that separating shaft 100 likewise can only be driven when support plates 52 have reached their lower end positions in guide slots 58.

Beneath cross member 54, at the positions corresponding to the upper corners of stack 14, pushers 110, each tensioned by a spring 108, are mounted on support plates 52, said pushers each having a separating corner 112 at their forward ends facing stack 14.

In this second embodiment, the device operates as follows:

To feed a single sheet, carriage 42 is moved to the selected stack 14. Electric motor 64 is then energized so that support plates 52 are moved downward. At this time, separating shaft 100 and separating rollers 102 are driven through free-running clutch 106 and toothed belt 104, and separating rollers 102 rotate counterclockwise as shown in FIG. 9. When the support plates 52 have reached their lower stop position, their drive is interrupted by the slip clutch. Separating shaft 100, which is now located between the selected stack 14 and support plate 16 of the previous stack, is powered further. Now carriage 42 is brought against stack 14. Separating corners 112 then come to rest against the top corners of stack 14 under spring tension. Separating rollers 102 come into frictional contact with the uppermost or end sheet on stack 14 and push this sheet upward. This causes the uppermost sheet to snap over separating corners 112 and be pushed into paper guideshaft 78 until it is curved convexly and has its upper edge against transport rollers 80. Then transport rollers 80 are driven by motor 82 to grip the sheet and hold it. Support plates 52 are then raised again by electric motor 64, with separating rollers 102 not being powered because of free-running clutch 106. Carriage 42 is then transported to dispensing slot 20 where the pulled-off sheet is transferred to office machine 10.

FIGS. 10 to 13 show a third embodiment. This third embodiment largely corresponds to the second embodiment in FIG. 9, so that reference will be made to the previous description and in the following only those differences relative to the embodiment in FIG. 9 will be explained.

In the embodiment described above in FIG. 9, the two separating corners 112 are brought up against pushers 110. Since separating corners 112 are thus lcoated in a given fixed position, only single sheet can be used with a single predetermined width corresponding to the spacing of separating corners 112.

To avoid this, in the embodiment shown in FIGS. 10 to 13, a separating frame 114 is placed on stack 14. Separating frame 114 is shown in detail in FIGS. 11 to 13. Separating frame 114, which is preferably a one-piece injection-molded plastic part, has an end wall 116 by which it rests on the top of stack 14. Side walls 118 project downward from this end wall 116, said side walls abutting the side edges of stack 14 and guiding separating frame 114 on stack 14. End wall 116 has a staggered height, as shown most clearly in FIG. 11, and projects from the upper edge of stack 14 in stages, as shown most clearly in FIG. 12. Consequently, end wall 116 has a central section **116*a* which has the lowest height and projects the furthest upward when separating from 14 rests on the top of stack 114. A section 116*b* with a slightly greater height symmetrically about this central section 116*a* on both sides, said section 116*b* projecting to a lesser distance. This is connected symmetrically by an outer section 116*c* which has the greatest height, projects the least distance forward, and abuts side walls 118. Separating corners 120 are molded at the respective upper outer corners of end wall sections 116*a*, 116*b*, and 116*c*, said corners projecting inward from end wall 116. The widths of end wall sections 116*a*, 116*b* and 116*c* correspond to the widths of different common paper formats. If separating frame 114 is therefore placed on a paper stack 114 which is narrower, separating frame 114 will have its central end wall section 116*a* resting on this stack as shown in FIG. 13*a* and the separating corners of this central end wall section 116*a* will act to cause separation by separating rollers 102. In the case of a paper format of a medium width, separating frame 114 has its central end wall section 116*b* resting on stack 14, as shown in FIG. 13*b*. Separating corners 120 of this central end wall section 116*b* are operative during separation. In the case of a paper format of maximum width, separating frame 114 has its outer end wall section 116*c* resting on stack 14 as shown in FIG. 13*c* and the outermost separating corners 120 become operative. The staggered height of end wall 116 ensures that when separation by separating corners 120 located further outward occurs, the sheet which jumps individually out of these separating corners 120 will not be impeded by the separating corners 120** located further inward.

Pushers 110, which have no separating corners in this embodiment, push separating frame 114 against stack 14, when carriage 42 with separating rollers 102 is moved against stack 14 so that separating corners 120 always fit tightly against the corners of stack 14 as is required for reliable separation.

Figure 14:
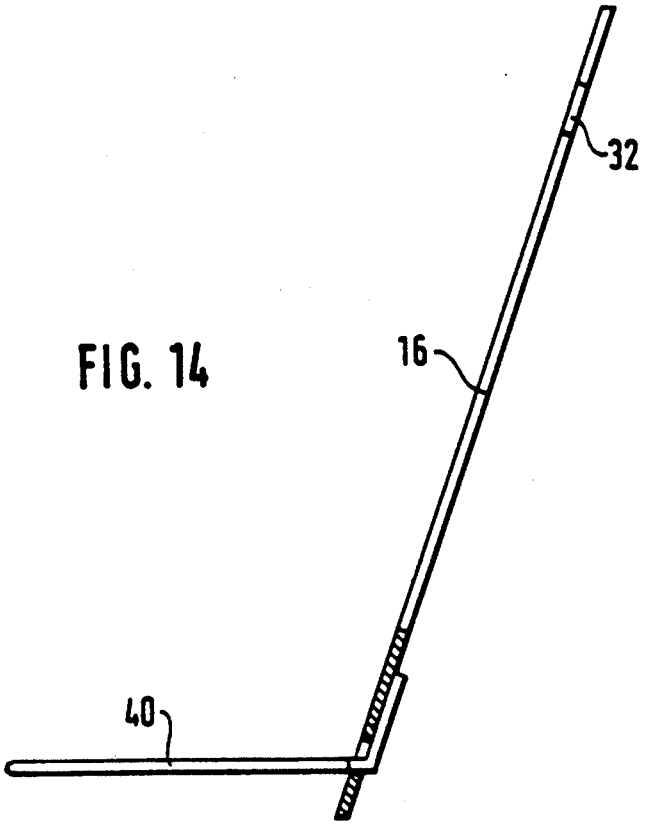
FIG. 14 is a side view of a support plate of the embodiment in FIG. 10.
Figure 15:
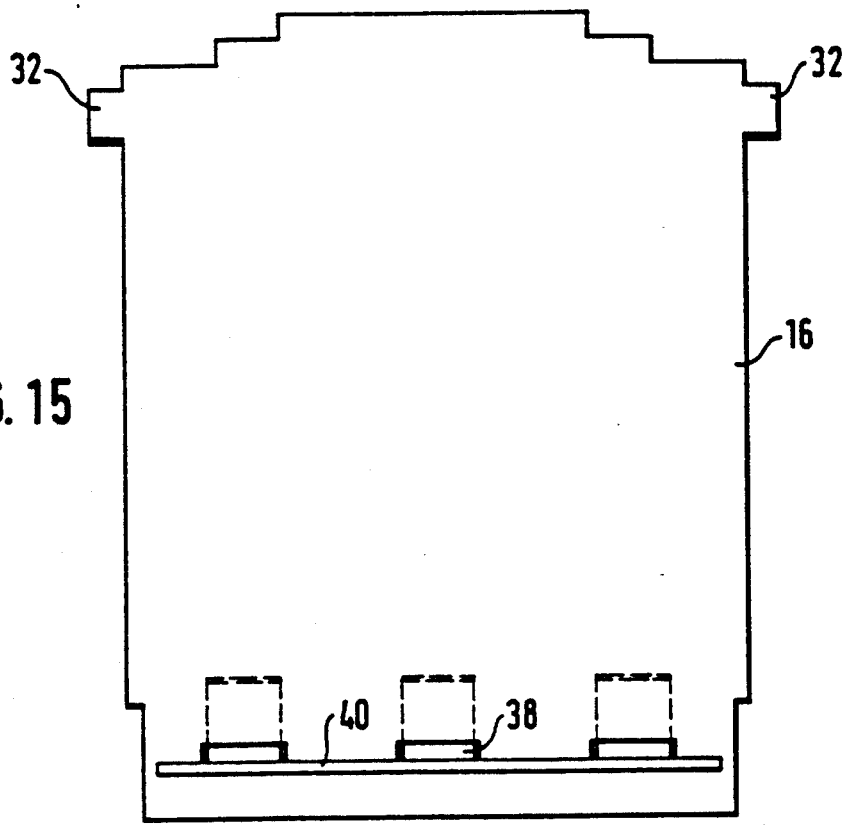
FIG. 15 is a front view of this support plate.

Support plates 16 in this third embodiment have the shape shown in FIGS. 14 and 15 in which the upper edges of support plates 16 are staggered to match the different degrees of projecting of end wall 116. As a result, firstly, separating frame 114 can be pushed unimpeded over supporting plates 16 as the thickness of stack 14 decreases. Secondly, all paper formats are supported by support plates 16 right up to the upper edge of the sheets, which is necessary for separation by separating corners 120. Side walls 118 can then be tongues projecting against supporting plate 16, said tongues entering matching openings in support plates 16 as the thickness of stack 14 decreases.

Figure 16:
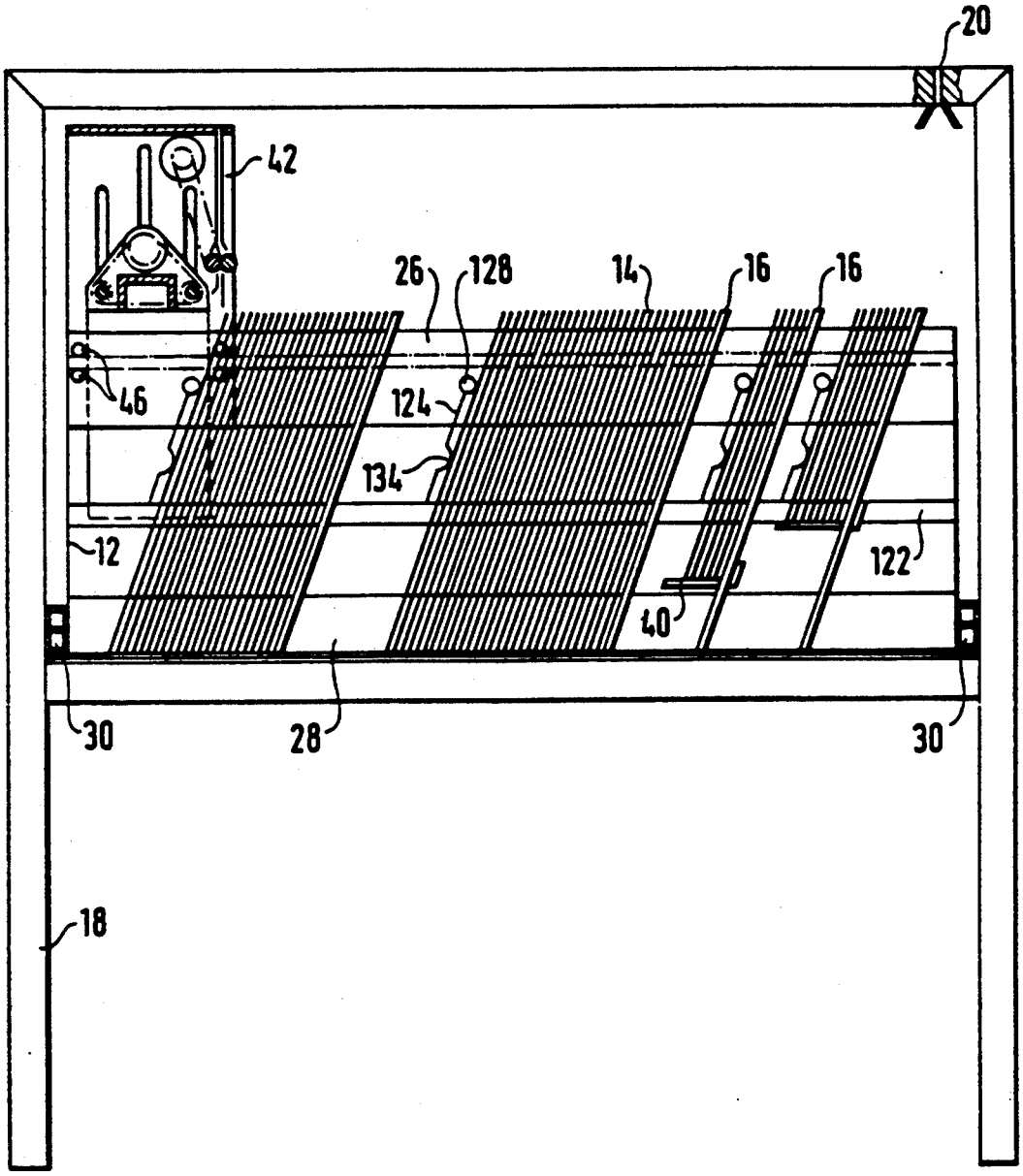
FIG. 16 is a side view of the device in a fourth embodiment.
Figure 17:
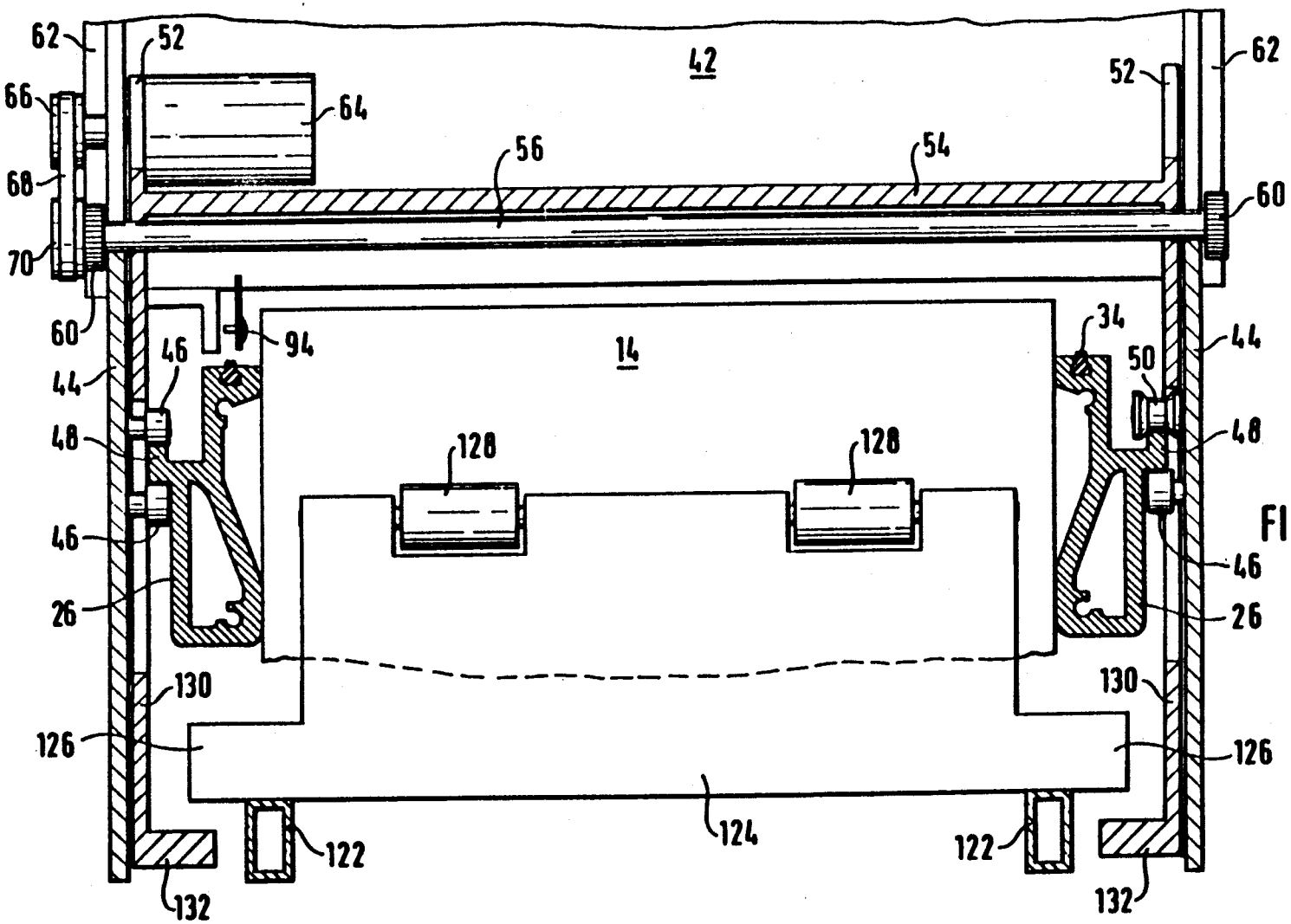
FIG. 17 is a cross-section through the carriage of the embodiment in FIG. 16.

FIGS. 16 and 17 show a fourth embodiment. To the extent that this embodiment corresponds with the embodiments described above, the same reference numbers have been used and reference is made to the previous description.

The fourth embodiment differs from the embodiments described above once again in the construction of the separating device. Below running rails 26 and parallel thereto, support rails 122 are mounted on both sides into magazine 12. A push frame 124 is inserted in front of stacks 14 inserted into magazine 12, said frame consisting for example of a plastic plate, a wire frame, or a punched metal frame. Push frame 124 has noses 126 projecting from its lower edge laterally over the width of stack 14, by which noses it rests on support rails 122. Push frame 124 extends halfway up from support rails 122 and has friction means 128 on its upper transverse edge. Push frame 124 engages the uppermost sheet in each stack 14 at a moderately acute angle with its friction elements 128.

The support plates 52 of carriage 42 are each extended downward by legs 130 and each engage an inwardly directed projection 132 at the level of support rails 122 form the outside beneath noses 126 of push frames 124, as shown in FIG. 14.

In the embodiment shown in FIGS. 16 and 17, the device operates as follows:

Carriage 42 is moved up to the selected stack 14 under control as described above. Support plates 52 are moved downward by electric motor 64 as shown in FIG. 16 so that projections 132 on legs 130 of these support plates 52 are at the height of support rails 122 beneath noses 126 of push frames 124, as shown in FIG 17. As soon as carriage 42 has reached the selected stack 14, electric motor 64 is energized and support plates 52 are raised. At this point, projections 132 engages noses 126 lifting push frame 124. As a result of the friction exerted by its frictional elements 128, push frame 124 thereby pushes the uppermost sheet of stack 14 upward, so that the letter enters paper guideway 78 and abut s transport rollers 80 with its upper edge convexly curved. Transport rollers 80 are then briefly driven by energizing motor 82 so that they engage and grip the upper edge of the sheet. Support plates 52 are then lowered again by electric motor 64 and carriage 42 can be moved to dispensing slot 20, whereby it pulls the sheet gripped by transport rollers 80 completely off stack 14 and transfers it to office machine 10 at dispensing slot 20.

Projections 132 are beveled towards stack 14 on their tops which come in contact with noses 126. When push frame 124 is raised, noses 126 slide on these bevels against stack 14 so that push frame 124 is necessarily adjusted to the decreasing thickness of stack 14. Spacing projections 134, directed toward stack 14, are provided on the push frames immediately above the noses 126, and determine the distance of the lower edge of push frame 124 from stack 14, thereby ensuring that push frame 124 and its frictional elements 128 always abut the uppermost sheet in stack 114 at the same optimum adjustment angle.

Separation according to the embodiment in FIGS. 16 and 17 is especially suitable for single sheets of high stiffness, covers for example, which would be very difficult if not impossible to separate using separating corners. On the other hand, since separation using separating corners and separating rollers is especially reliable for thin papers of limited stiffness, the separating apparatus of the second and third embodiments can also be combined with the separating apparatus of the fourth embodiment, if single sheets of limited stiffness as well as covers or the like are to be fed from the same magazine.

With a combination of this kind, carriage 42 carries the separating device for the second and third embodiments and support plates 52 are also made with legs 130 with projections 132 according to the fourth embodiment. The paper stacks are inserted into the magazine in the usual fashion. When a stack of single sheets of substantial stiffness, in other words, a stack of covers, is inserted into the magazine, this stack is additionally provided with a push frame 124.

When feeding single sheets of limited stiffness, the separating process takes place in the same fashion as explained above for the second and third embodiments. The distance between the top of a stack of covers 14 and support plate 16 of the previous stack 14 however must be made larger than the space between stacks 14 of thinner paper. To separate a cover, support plates 52 are lowered to the lower position between cover stack 14 and support plate 16 of the previous stack, without separating corners 112 and separating rollers 102 coming into contact with the cover stack. When cover panels 52 have been lowered to the point where projections 132 are at the level of support rails 122, carriage 42 is again moved toward cover stack 14 and projections 132 pass beneath noses 126 of push frame 124. Now support plates 52 can be raised in order to push the uppermost cover over push frame 124 to transport rollers 80 of carriage 42.

Figure 18:
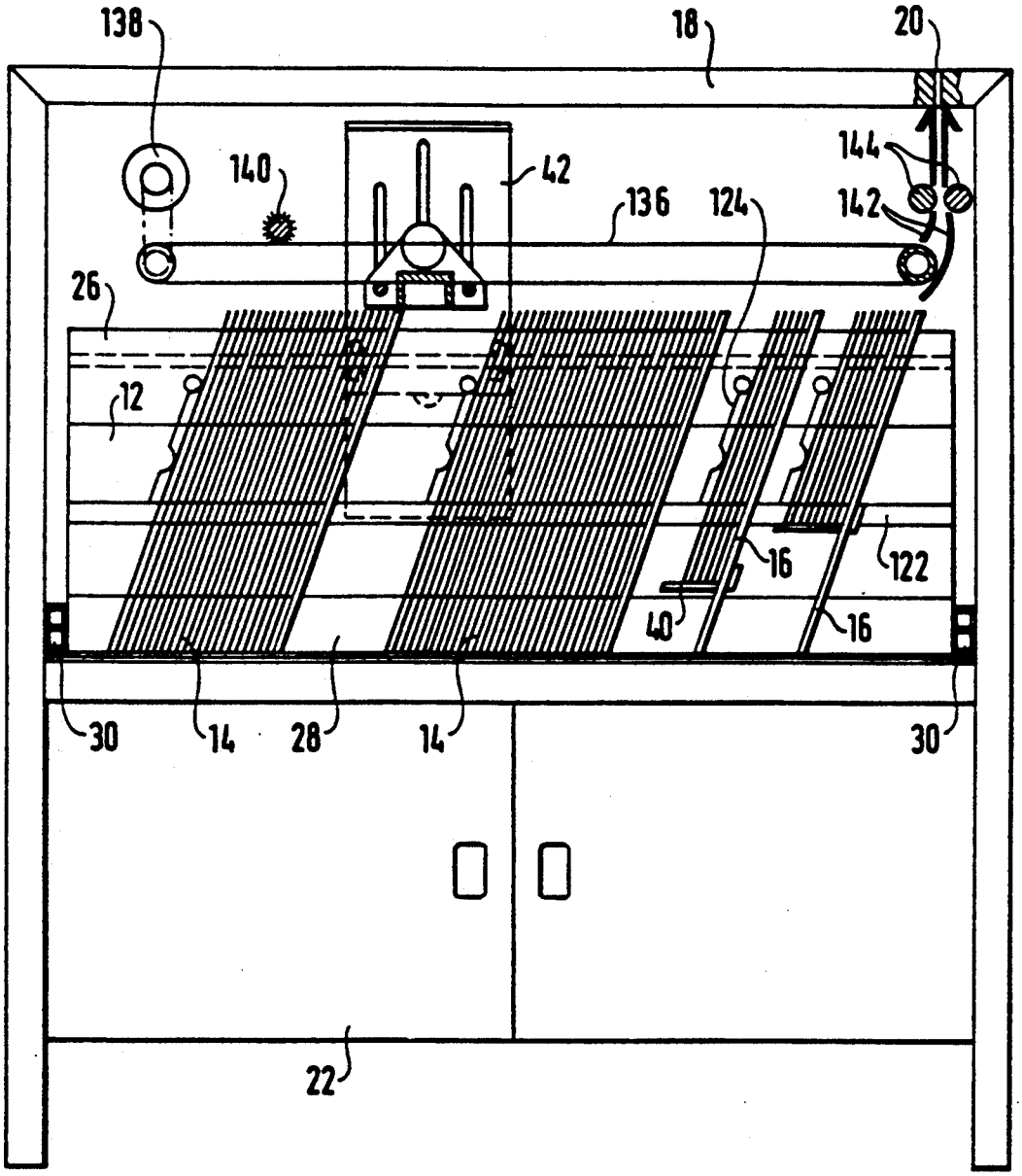
FIG. 18 is a side view of the device in a fifth embodiment.

In the embodiments described above, the sheets separated individually from stack 14 are engaged by transport rollers 80 of carriage 42 and delivered by carriage 42 to dispensing slot 20 where they are passed to office machine 10. In FIG. 18, a fifth transport device is shown in a fifth embodiment, by which the sheets pulled off individually can be conveyed to dispensing slot 20.

Carriage 42 in this embodiment has some of the separating devices described above. Reference is made to the above description of the various embodiments.

Carriage 42 in this fifth embodiment, however, has no paper guide shaft 78 and no transport rollers 80 driven by a motor 82. Above stack 14, an endlessly circulating conveyor belt 136 is mounted over the entire length of magazine 12. This belt being driven by a motor 138. Conveyor belt 136 consists of an electrically insulating material, i.g. a plastic, and is kept electrostatically charged by a rotating brush 140. The single sheets, separated indvidually from selected stack 14, are pushed by the separating device from below against conveyor belt 136 which carries a strong electrostatic charge, and are held on the belt by the electrostatic attraction. Circulating conveyor belt 136 carries the electrostatically adhering single sheets to a paper guideway 142 located at the reversing point of conveyor belt 136 below dispensing slot 20. At the reversing point of conveyor belt 136, the sheet is separated from conveyor belt 136 and guided by powered transport rollers 144 in paper guide shaft 142 to dispensing slot 20 where the sheet is transferred to office machine 10.

In this embodiment, carriage 42 need not be moved to dispensing slot 120 after each separation in order to transfer the separated sheet to office machine 10. Carriage 42 instead, after transferring the sheet to conveyor belt 136, can be moved directly to the next selected stack 14 or remain at rest if more sheets are to be separated sequentially from the same stack 14.

Figure 19:
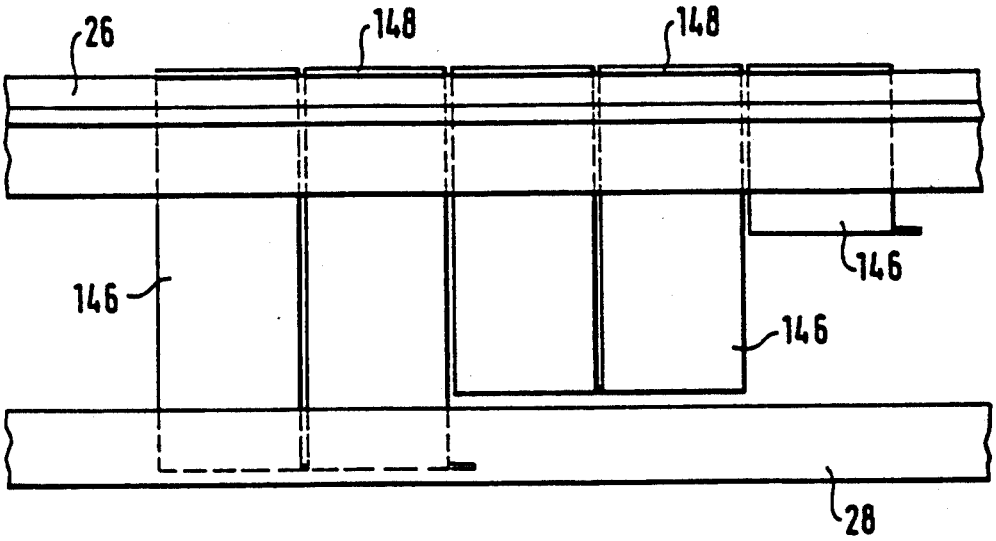
FIG. 19 is a side view of the magazine of the device in a sixth embodiment.
Figure 20:
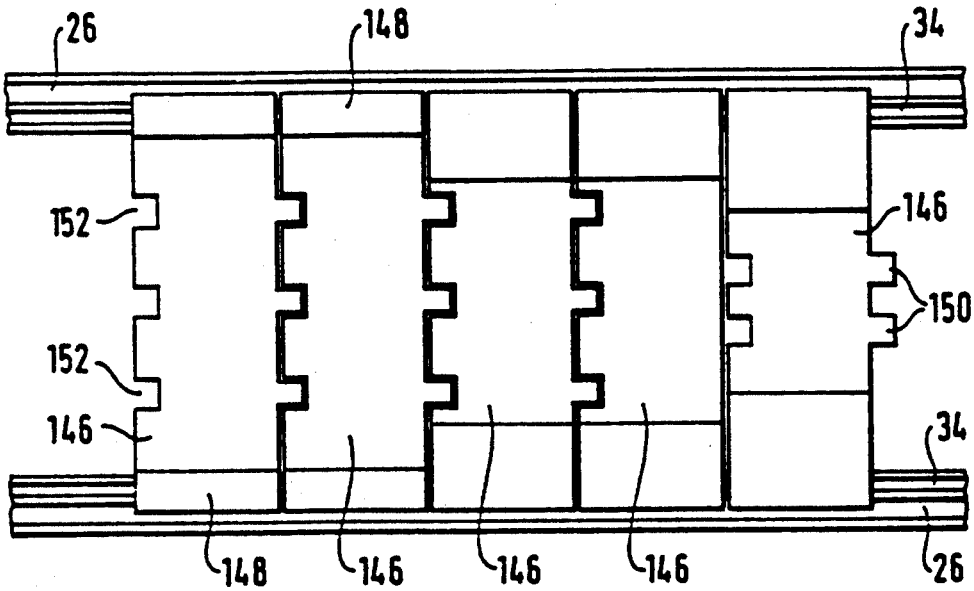
FIG. 20 is a top view of the magazine in FIG. 19.
Figure 21:
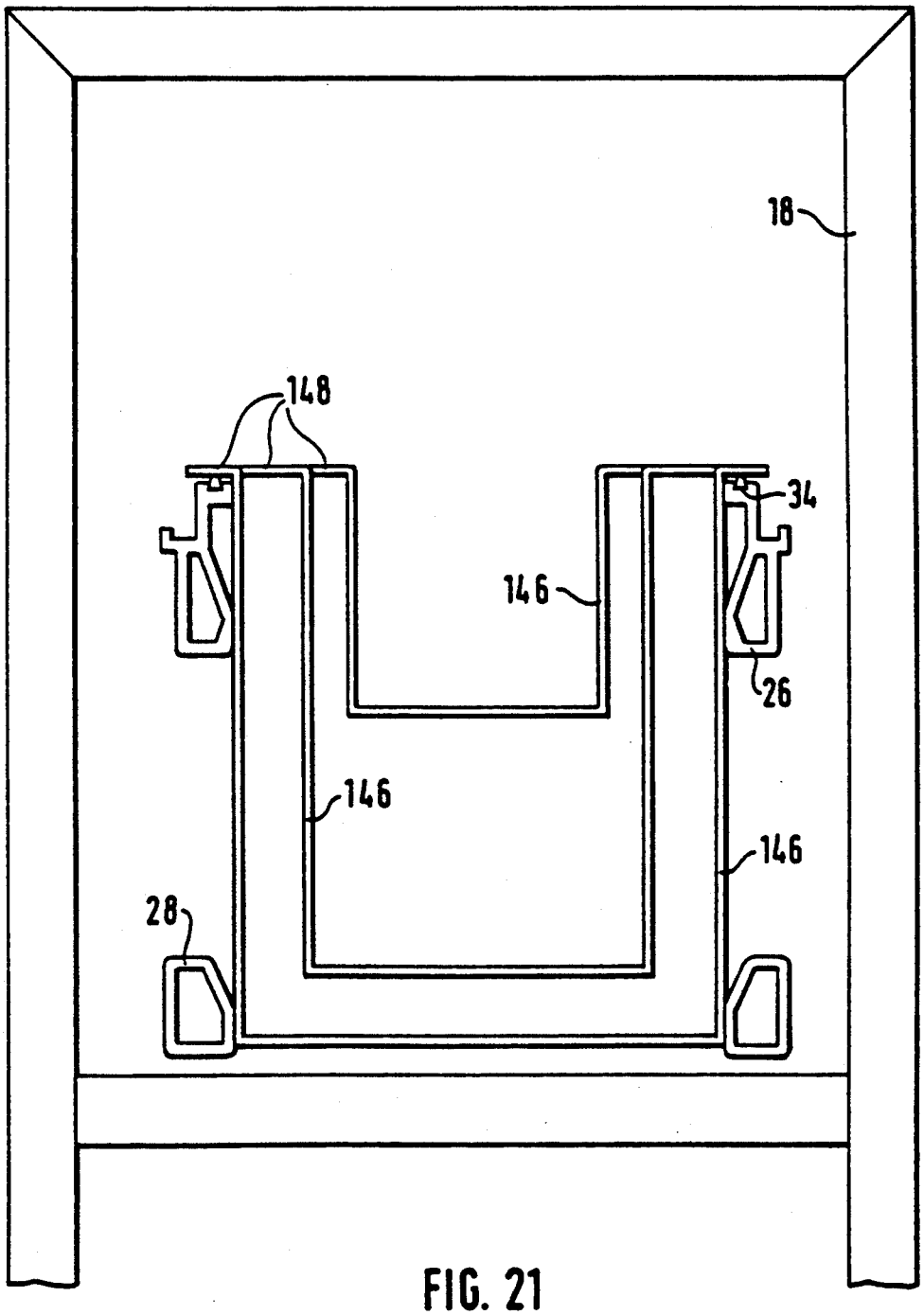
FIG. 21 is a front view of the magazine in FIG. 19.

In FIGS. 19 to 21, another construction of the device is shown. In order to store sheets of different formats in magazines in such a way that the upper edges of the essentially vertical stacks are all at the same height, to be accessed by the separating mechanism, in this embodiment tubs 146 are placed in the box-shaped receiving chamber of magazine 12. Stacks 14 and support plates 16 are inserted into these tubes 146.

Tubs 146 are simple sheet metal or plastic parts and have a U-shaped box profile which is open at the top and at the two ends in the lengthwise direction of magazine 12. Outwardly projecting flanges 148 are molded on the upper edges of upwardly directed side parts of tubs 146 by which flanges suspended tubes 146 rest on running rails 26. The width and height of tubs 146 correspond to the format of the single sheets placed therein. Support plates 16 have their lower edges resting on the bottoms of tubs 146 and have their lateral noses 32 resting on top of flanges 148 of the tubs.

In order to ensure a considerable degree of variation relative to sheet formats and the thickness of sheet stacks, tubs 146 may be assembled module-wise from individual sections which are fitted together in the lengthwise direction of magazine 12. To prevent the sheets standing in tubs 146 from sliding through the joints of the sections of tube 146 abutting one another, tubs 146 have projections 150 running lengthwise along one edge of their bottoms and have matching cutouts 152 on their opposite bottom edges. When tub segments of the same format are fitted together, projections 150 of one segment fit into cutouts 152 of the adjoining segment, so that no continuous butt joints result in the bottoms of tubs 146, through which the sheets could slid.

The claims and specification describe the invention presented, and the terms that are employed in the claims draw their meaning from the use of such terms in the specification. Some terms employed in the prior art may be broader in meaning than specifically employed herein. Whenever there is a question between the broader definition of such term as used in the prior art and the more specific use of the term herein, the more specific meaning is meant.

I claim:

1. Apparatus for automatically withdrawing single sheets from plural stacks of sheets comprising:

a substantially horizontally extending magazine for receiving plural stacks of sheets, a plurality of stack supports in said magazine, each for supporting a stack of sheets standing substantially vertically in said magazine, a holder for plural stack supports for enabling at least one stack support to be positioned at any distance within said magazine from an adjacent stack support, a housing having an open side, and means for supporting said magazine for movement through said open side of said housing.

2. Apparatus according to claim 1, wherein said means comprises telescopic rails.

3. Apparatus for automatically withdrawing single sheets from plural stacks of sheets comprising:

a magazine for receiving plural stacks of sheets, a plurality of stack supports in said magazine, each for supporting a stack of sheets, said stack supports each comprising a support for engaging the surface of an end sheet of a said stack, each stack support further comprising a support angle for engaging and supporting the lower edges of said sheets of a stack, means for holding each said support angle at different selected distances from the upper edge of it repective support, and a holder for plural stack supports for enabling at least one stack support to be positioned at any distance within said magazine from an adjacent stack support.

4. Apparatus according to claim 3, and further comprising guide strips pivotably connected to each said support at the lateral edge thereof.

5. Apparatus for automatically withdrawing single sheets from plural stacks of sheets comprising:

a magazine for receiving plural stacks of sheets, a plurality of stack supports in said magazine, each for supporting a stack of sheets, a holder for plural stack supports for enabling at least one stack support to be positioned at any distance within said magazine from an adjacent stack support, said stack supports each comprising a support for engaging the surface of an end sheet of a said stack, said magazine having an upwardly facing surface adjacent the bottom thereof and upper, spaced rails, each said stack support comprising a lower edge engaging said upwardly facing surface of said magazine, and having laterally projecting noses near the upper edges thereof engaging said rails of said magazine, each said support being inclined at an angle to the vertical.

6. Apparatus according to claim 5, and further comprising sheet removing means comprising motor driven frictional elements, means for causing said frictional elements to engage an endmost sheet of a selected stack, and separating corners engageable with the upper corners of the selected stack.

7. Apparatus according to claim 6, said motor driven frictional elements comprising rollers.

8. Apparatus for automatically withdrawing single sheets from plural stacks of sheets comprising:

a magazine for receiving plural stacks of sheets, said magazine comprising a receiving chamber for stacks of sheets, a plurality of stack supports in said magazine, each for supporting a stack of sheets, said magazine comprising end members, a holder for plural stack supports for enabling at least one stack support to be positioned at any distance within said magazine from an adjacent stack support, and two laterally spaced and parallel upper rails and two laterally spaced and parallel lower rails at a level below said upper rails, said upper and lower rails being connected to said end members.

9. Apparatus for automatically withdrawing single sheets from plural stacks of sheets comprising:

a magazine for receiving plural stacks of sheets, a plurality of stack supports in said magazine, each for supporting a stack of sheets, a holder for plural stack supports for enabling at least one stack support to be positioned at any distance within said magazine from an adjacent stack support, a separating device, means for moving said separating device in front of the ends of the stacks of sheets an said stack supports comprising a carriage, said separating device comprising means for removing a sheet from a stack of sheets, means for moving said sheet removing means transversely of the fronts of said stacks, said means for removing a sheet from a stack of sheets being mounted on said carriage and movable thereby against the stacks, and further comprising separating means for engaging each stack at the upper end thereof, said separating means comprising two separating corner elements, means for mounting said separating corner elements at said supports, and resilient means for urging said separating corner elements against a said stack.

10. Apparatus according to claim 9, and further comprising a separating frame, said separating corner elements being supported by said separating frame.

11. Apparatus according to claim 10, wherein a plurality of pairs of separating corner elements staggerd with respect to one another are on a said separating frame, there being a different width between each pair of separating corner elements.

12. Apparatus for automatically withdrawing single sheets from plural stacks of sheets comprising:

a magazine for receiving plural stacks of sheets, a plurality of stack supports in said magazine, each for supporting a stack of sheets, a holder for plural stack supports for enabling at least one stack support to be positioned at any distance within said magazine from an adjacent stack support, a separating device, means for moving said separating device in front of the ends of the stacks of sheets in said stack supports comprising a carriage, said separating device comprising means for removing a sheet from a stack of sheets, means for moving said sheet removing means transversely of the fronts of said stacks, means on said carriage for transporting sheets pulled from said stacks, said transporting means comprising at least one motor driven roller engageable with a sheet pulled from said stack.

* * * * *